US006966378B2

(12) United States Patent
Hromas et al.

(10) Patent No.: US 6,966,378 B2
(45) Date of Patent: Nov. 22, 2005

(54) METHOD AND APPARATUS FOR PERFORATING A WELL

(75) Inventors: Joe C. Hromas, Sugar Land, TX (US); Mark Vella, Kingswells (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 163 days.

(21) Appl. No.: 10/405,283

(22) Filed: Apr. 2, 2003

(65) Prior Publication Data

US 2003/0196806 A1 Oct. 23, 2003

Related U.S. Application Data

(60) Provisional application No. 60/369,424, filed on Apr. 2, 2002.

(51) Int. Cl.[7] ..... E21B 29/00; E21B 19/16; E21B 23/00

(52) U.S. Cl. ..... 166/298; 166/55.2; 166/242.6; 166/378; 175/2; 285/321

(58) Field of Search ..... 166/297, 298, 166/381, 384, 378, 55, 55.1, 55.2, 242.6; 175/2; 102/311–324; 403/367, 368, 371, 403/361; 285/321

(56) References Cited

U.S. PATENT DOCUMENTS 4,862,964 A 9/1989 George et al.
4,865,964 A 9/1989 Newmiller
5,007,344 A 4/1991 Ricles et al.
5,273,121 A 12/1993 Kitney et al.
5,366,014 A * 11/1994 George ..... 166/297
5,509,481 A * 4/1996 Huber et al. ..... 166/297
5,680,905 A * 10/1997 Green et al. ..... 175/4.54
5,778,979 A 7/1998 Burleson et al.
5,803,175 A * 9/1998 Myers et al. ..... 166/297
5,957,209 A * 9/1999 Burleson et al. ..... 166/380
5,992,523 A * 11/1999 Burleson et al. ..... 166/297
6,056,055 A * 5/2000 Falconer et al. ..... 166/297
6,059,042 A * 5/2000 Huber et al. ..... 166/377
6,098,716 A 8/2000 Hromas et al.
6,148,916 A * 11/2000 Sampson et al. ..... 166/297
6,315,043 B1 11/2001 Farrant et al.
6,651,747 B2 * 11/2003 Chen et al. ..... 166/382
6,691,776 B2 * 2/2004 Guillory et al. ..... 166/187
2002/0053434 A1 * 5/2002 Chen et al. ..... 166/297
2002/0100360 A1 * 8/2002 Rochen et al. ..... 89/1.15
2002/0185276 A1 * 12/2002 Muller et al. ..... 166/297
2003/0098155 A1 * 5/2003 Guillory et al. ..... 166/242.6

FOREIGN PATENT DOCUMENTS

WO WO 01/04459 A1 1/2001

* cited by examiner

*Primary Examiner*—Jennifer H Gay
(74) *Attorney, Agent, or Firm*—Trop, Pruner & Hu PC; Bryan P. Galloway; Jaime A. Castaño

(57) ABSTRACT

The present invention provides for a perforating gun having stackable sections that latch, enabling the gun string to carry both compressive and tensile loads. This allows for the downhole assembly of guns of any desired length, and for the entire gun string to be removed after firing.

26 Claims, 3 Drawing Sheets

METHOD AND APPARATUS FOR PERFORATING A WELL

This application claims the benefit of U.S. Provisional Application 60/369,424 filed Apr. 2, 2002.

BACKGROUND

1. Field of Invention

The present invention pertains to perforating guns used in subsurface wells, and particularly to perforating guns having stackable sections.

2. Related Art

It is often desirable to perforate zones of interest in a subterranean well with very long gun strings to maximize production of well fluids, such as hydrocarbons. This is particularly true in horizontal or highly deviated wells. Gun strings may range in length from a few hundred feet to several thousand feet. Perforating guns are often run into the well using coiled tubing, though drill string may be used if a rig is present at the well site.

Generally, it is faster and safer to run and retrieve a gun string in an underbalanced well using coiled tubing. (Underbalanced operations help prevent damage to formations.) If drill string is used, a snubbing unit must also be used to seal and control pressure from well fluids. Though coiled tubing may be faster and safer, its use may limit the length of the gun string because the coiled tubing can only push so much load before its buckling strength is exceeded. This is particularly true in horizontal or nearly horizontal wells.

There are existing systems for downhole stacking of guns. U.S. Pat. No. 6,098,716, assigned to Schlumberger Technology Corporation, is one example. However, those prior art systems have sections that are intended to be stacked in vertical or nearly vertical holes, not horizontal holes. The Schlumberger system uses a connector that mechanically latches in compression, but is not designed to carry a tensile load. Other prior art systems stack, but do not latch at all, and thus can carry neither compressive nor tensile loads. Thus, there is a continuing need for improved sectional perforating guns.

SUMMARY

The present invention provides for a perforating gun having stackable sections that latch, enabling the gun string to carry both compressive and tensile loads. This allows for the downhole assembly of guns of any desired length, and for the entire gun string to be removed after firing.

Advantages and other features of the invention will become apparent from the following description, drawings, and claims.

DETAILED DESCRIPTION

Figure 1:
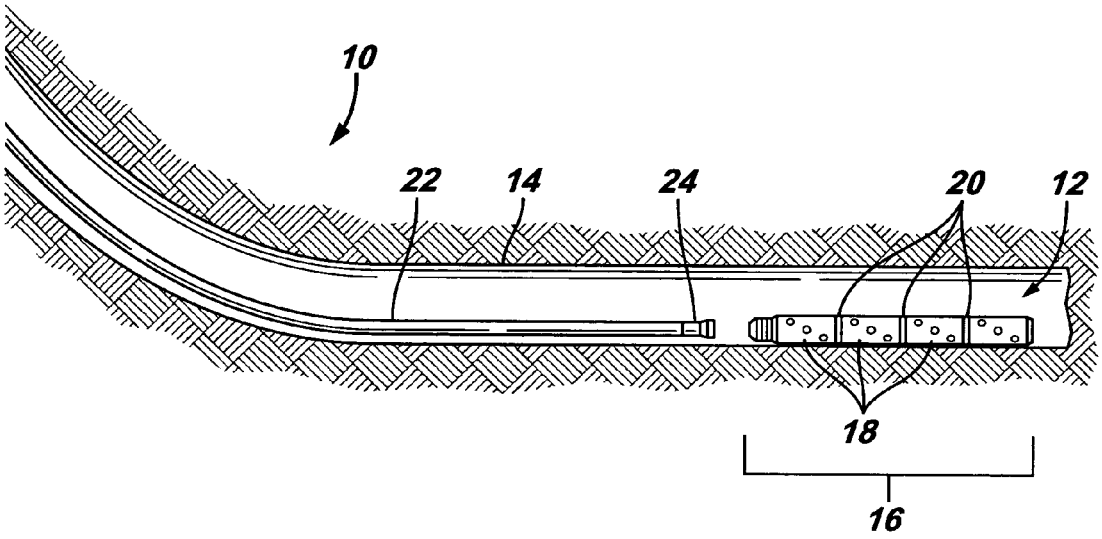
FIG. 1 is a schematic diagram of a perforating gun assembly constructed in accordance with the present invention, showing the placement of the lowermost section.

FIG. 1 shows a completion assembly 10 including a perforating gun string 12. Gun string 12 is disposed in a lower portion of a horizontal or highly deviated well bore 14. Gun string 12 comprises sections 16 (FIG. 2), and each section 16 further comprises subsections 18. Subsections 18 may be joined using specialized connectors 20, such as the Completions Insertion and Retrieval Under Pressure Connectors disclosed in U.S. Pat. No. 6,059,042, to permit assembly and disassembly of sections 16 while maintaining well bore 14 in an underbalanced state. FIG. 1 shows coiled tubing 22 being used to place section 16 in well bore 14, though drill string (not shown) may also be used.

Figure 2:
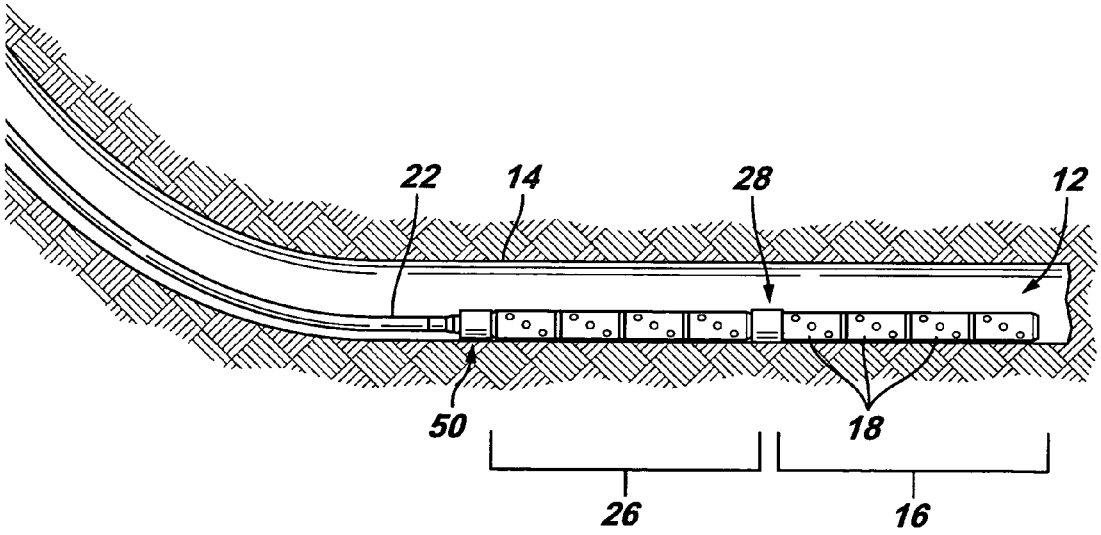
FIG. 2 is a schematic diagram of the gun assembly of FIG. 1 showing the addition of another section.

Coiled tubing 22 has a disconnector 24 on its lower end. Disconnector 24 may be hydraulically or mechanically actuated, as is well known in the art, and can releasably engage each section 16, as described further below. FIG. 2 shows a subsequent, adjoining section 26 run in and mechanically and ballistically connected to section 16 using a connector 28. Swivels and weighted spacers may be incorporated in strategic locations of gun string 12 to allow the charges to align in a particular plane, should that be desired.

Figure 3:
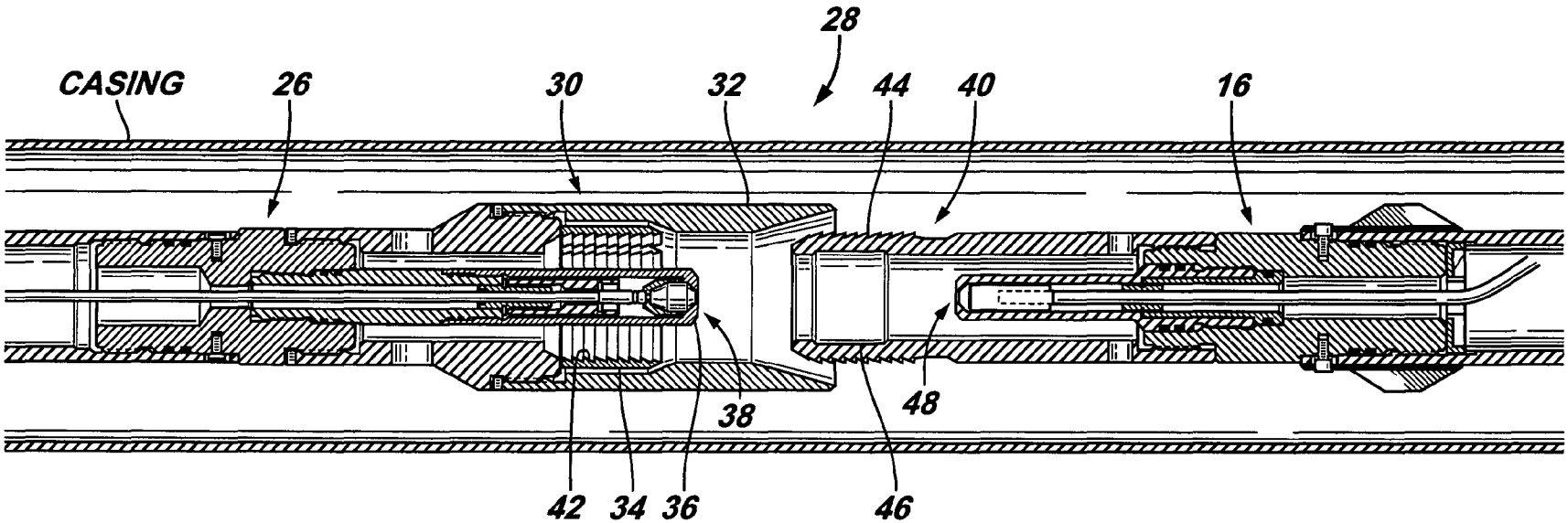
FIG. 3 is an enlarged view of a connector, shown in its unconnected state, used to join the sections of the gun assembly of FIG. 2.

FIG. 3 shows connector 28 in its unconnected state. The upper portion 30 of connector 28, located on the lower end of section 26, comprises an overshot 32, a C-ring 34, and a donor portion 36 of a sealed ballistic transfer 38. Overshot 32 helps guide upper portion 30 onto a lower portion 40 of connector 28. Lower portion 40 is located on the upper end of section 16.

C-ring 34 incorporates internal buttress threads 42 that allow C-ring 34 to slide onto a mating set of buttress threads 44 in one direction, but prevent C-ring 34 from coming off in the opposite direction. C-ring 34 is split to allow it to expand and contract to engage mating threads 44. C-ring 34 is constrained to remain within upper portion 30, but is allowed to 'float' for alignment and engagement purposes. Once engaged with mating threads 44, C-ring 34 and upper portion 30 cannot be disconnected from lower portion 40 while in well bore 14.

Figure 4:
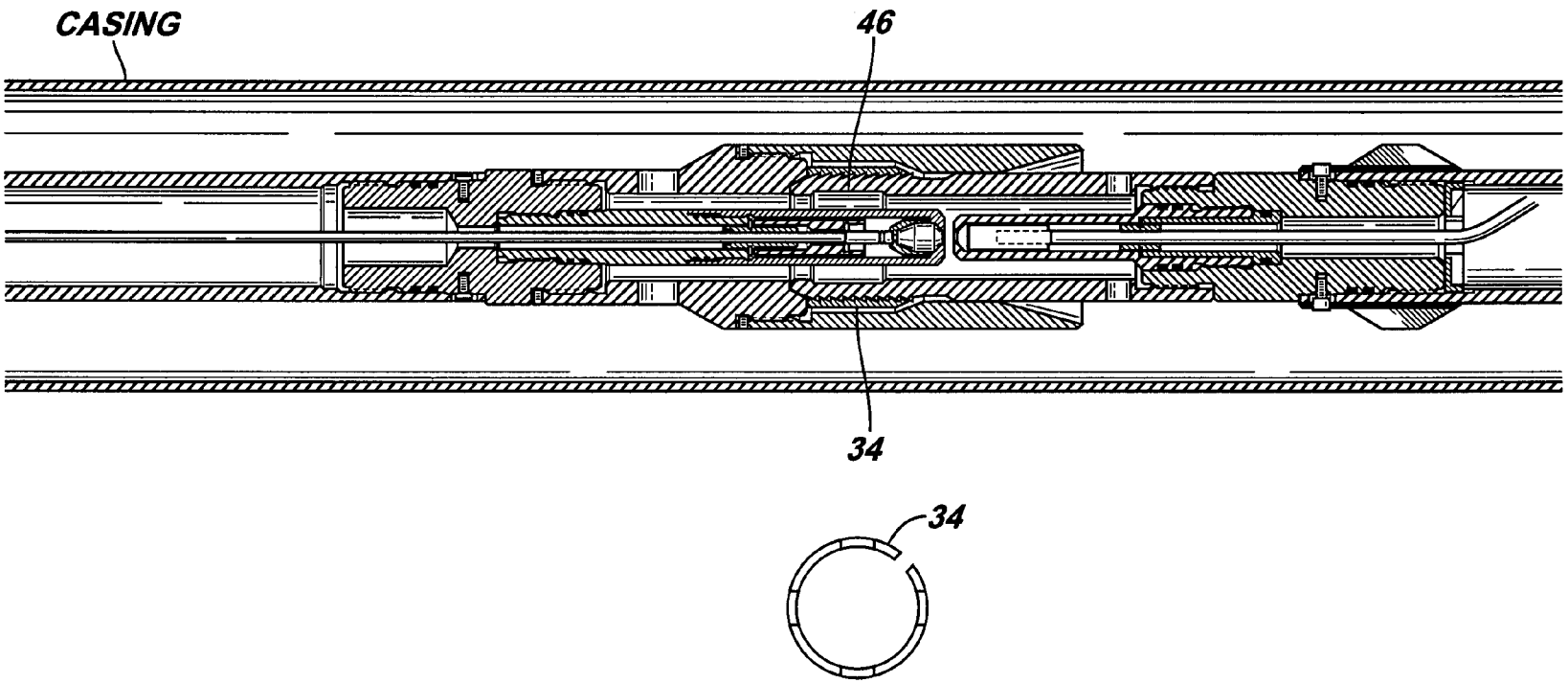
FIG. 4 is an enlarged view of the connector of FIG. 3, shown in its connected state, used to join the sections of the gun assembly of FIG. 2.

FIG. 4 shows connector 28 in its connected state. As mentioned above, lower portion 40 of connector 28 contains mating buttress threads 44 for C-ring 34. Lower portion 40 also has an internal running/retrieving profile 46 and a receptor portion 48 of sealed ballistic transfer 38. Disconnector 24 engages and disengages with profile 46 to connect or release coiled tubing 22 from each section 16. External buttress threads 44 provide a latching point for C-ring 34. Receptor portion 48 allows for the continuation of the ballistic train from gun section 26 to gun section 16. A blank section (devoid of charges) of tubing having connector 28 can be inserted in gun string 12 between charge-bearing sections so long as the ballistic train is maintained therethrough.

In operation, an appropriate length for section 16 is determined to prevent coiled tubing 22 from buckling and locking up during insertion of section 16 into well bore 14. The first gun section 16 to be run into well bore 14 is picked up, disconnector 24 is latched into profile 46, and section 16 is run in to the desired depth. Disconnector 24 is then actuated to release section 16. For example, if disconnector 24 is hydraulically actuated, fluid is pumped down an interior passageway of coiled tubing 22 to release disconnector 24. Coiled tubing 22 is then removed from well bore 14. The next gun section 16 (e.g., section 26) is picked up and run in the same way, and latched onto the lower portion 40 of connector 28. Subsequent gun sections 16 are run in as required until a desired length is reached. A firing head 50 (FIG. 1) is attached to coiled tubing 22 or uppermost gun section 16. This terminal section 16 is run in well bore 14 and latched onto the adjoining lower section 16.

Gun string 12 can be fired in various ways, depending on the type of firing head 50 used. For example, to fire gun string 12 using a pressure-actuated firing head 50, a ball (not shown) is pumped down coiled tubing 22 until it lands in a seat (not shown) in firing head 50. Pressure is increased to a predetermined level to shear a shear pin and initiate firing. Gun string 12 then fires along its entire length. Other firing head options are feasible, such as a hydraulic delay firing head. The coiled tubing 22 can remain attached or be disconnected and removed from well bore 14 before firing.

After firing, well bore 14 is perforated. The entire gun string 12 can be retrieved to surface and gun sections 16 can be removed from well bore 14. If specialized connectors 20 were used to assemble sections 16, the sections can be removed without killing the well.

An alternative operation would be to run the entire gun string 12 into well bore 14 with drill pipe (not shown), disconnect with disconnector 24, fire gun string 12, and retrieve the entire gun string 12 with coiled tubing 22 using specialized connectors 20. The drill pipe is strong enough to allow the entire gun string 12 to be run in all at one time, or it can be run in in sections as described above. If drill pipe is used to retrieve the guns after perforating, a snubbing unit is required to remove sections 16 without killing the well.

Although only a few example embodiments of the present invention are described in detail above, those skilled in the art will readily appreciate that many modifications are possible in the example embodiments without materially departing from the novel teachings and advantages of this invention. Accordingly, all such modifications are intended to be included within the scope of this invention as defined in the following claims. It is the express intention of the applicant not to invoke 35 U.S.C. §112, paragraph 6 for any limitations of any of the claims herein, except for those in which the claim expressly uses the words 'means for' together with an associated function.

What is claimed is:

1. A perforating assembly for use in a wellbore, comprising:

a deployment string;

a gun string comprising at least two sections, each section being individually deployed by the deployment string to a downhole location in the wellbore; and a connector to join each adjacent pair of sections at the downhole location in the wellbore such that the gun string can carry compressive and tensile forces.

2. The perforating assembly of claim 1 in which the deployment string is coiled tubing.

3. The perforating assembly of claim 1 in which each section of the gun string is assembled or disassembled at the downhole location in the wellbore while the well is maintained in an underbalanced state.

4. The perforating assembly of claim 1 in which the connector comprises an upper ring attached to a lower end of one section of the gun string and a lower ring attached to an upper end of an adjacent lower section of the gun string.

5. The perforating assembly of claim 4 in which the upper and lower rings have complementary mating teeth that allow relative translational motion in one direction, but not in the opposite direction.

6. The perforating assembly of claim 5, wherein the mating teeth that allow relative translational motion in one direction, but not in the opposite direction, enable locking of the upper and lower rings without having to provide relative rotation of the upper and lower rings.

7. The perforating assembly of claim 4 in which at least one ring is split along its length to form a "C-ring".

8. The perforating assembly of claim 1 in which the connector has an upper ballistic train and a lower ballistic train.

9. The perforating assembly of claim 8 in which the connector further comprises an upper ring attached to a lower end of one section of the gun string and a lower ring attached to an upper end of an adjacent lower section of the gun string.

10. The perforating assembly of claim 1 in which the connector has a profile adapted to receive a disconnector device.

11. The perforating assembly of claim 1 further comprising a firing head.

12. The perforating assembly of claim 1, wherein each section is individually deployed by the deployment string to one of a horizontal portion or near horizontal portion of the wellbore, the connector to join each adjacent pair of sections at the one of the horizontal portion or near horizontal portion of the wellbore.

13. The perforating assembly of claim 1, further comprising a disconnector connected to the deployment string, the disconnector to engage a portion of the connector to individually deploy a first one of the sections to the downhole location, and the disconnector to disengage from the portion of the connector after deployment of the first section to the downhole location to allow withdrawal of the deployment string from the wellbore.

14. The perforating assembly of claim 13, the disconnector to further engage a second one of the sections to individually deploy the second section to the downhole location to enable connection by the connector of the first and second sections at the downhole location in the wellbore.

15. A method of perforating in a wellbore, comprising:

attaching a deployment tool to a first section of a perforating gun string;

running in the first section to a downhole location in the wellbore;

releasing the first section from the deployment tool at the downhole location in the wellbore;

retrieving the deployment tool;

attaching the deployment tool to a second section of the perforating gun string;

running in the second section until it joins with the first section at the downhole location in the wellbore to form a union capable of carrying compressive and tensile forces;

firing the perforating gun string; and retrieving the perforating gun string.

16. The method of claim 15 further comprising building the perforating gun string to any desired length by joining sections at the downhole location of the wellbore in a like manner until the desired length is attained.

17. The method of claim 15 further comprising running in a firing head to connect to the uppermost section.

18. The method of claim 15 further comprising maintaining the well in an underbalanced condition.

19. The method of claim 15, wherein running in the first section to the downhole location comprises running in the first section to one of a horizontal portion or a near-horizontal portion of the wellbore, wherein releasing the first section from the deployment tool at the downhole location comprises releasing the first section from the deployment tool at the one of the horizontal portion or near-horizontal portion, and wherein running in the second section until the second section joins with the first section at the downhole location comprises running in the second section until the second section joins with the first section at the one of the horizontal portion or near-horizontal portion of the wellbore.

20. The method of claim 15, wherein joining the second section with the first section comprises joining the second section with the first section using a connector having an upper portion and a lower portion, the upper and lower portions of the connector having mating teeth that allow relative translational motion in one direction, but not in an opposite direction.

21. The method of claim 20, wherein the mating teeth that allow relative translational motion in one direction, but not in the opposite direction, enable locking of the upper and lower portions of the connector without having to provide relative rotation of the upper and lower portions.

22. A connector for use in a well comprising:

an upper portion having a housing, an upper ring disposed within the housing, and an upper ballistic transfer member; and a lower portion having a lower ring complementary to the upper ring, and a lower ballistic transfer member, wherein the upper and lower rings have mating teeth that allow relative translational motion in one direction, but not in an opposite direction, wherein the mating teeth that allow relative translational motion in one direction, but not in the opposite direction, enable locking of the upper portion to the lower portion without having to provide relative rotation of the upper and lower portions.

23. The connector of claim 22 in which at least one ring is split along its length to form a "C-ring".

24. The connector of claim 22 in which the upper ring is constrained from translational motion along a longitudinal axis of the housing.

25. The connector of claim 22 in which the teeth are on an inner surface of the lower ring.

26. The connector of claim 22 in which the teeth are adapted to receive a disconnector device.

* * * * *